US005188315A

United States Patent [19]

Foitzik et al.

[11] Patent Number: 5,188,315

[45] Date of Patent: Feb. 23, 1993

[54] SUBMUNITION UNIT INCLUDING A ROTARY PARACHUTE

[75] Inventors: Roland Foitzik, Mettmann; Karl-Friedrich Doherr, Brunswick; Dieter Münscher, Brunswick; Christos Saliaris, Brunswick, all of Fed. Rep. of Germany

[73] Assignee: Rheinmetall GmbH, Düsseldorf, Fed. Rep. of Germany

[21] Appl. No.: 917,288

[22] Filed: Jul. 23, 1992

[30] Foreign Application Priority Data

Jul. 27, 1991 [DE] Fed. Rep. of Germany ..... 4124960

[51] Int. Cl.[5] ..... B64D 17/14

[52] U.S. Cl. ..... 244/152; 244/149; 244/150; 102/339; 102/387

[58] Field of Search ..... 244/149, 142, 150; 102/339, 387, 337

[56] References Cited

U.S. PATENT DOCUMENTS

| | | | |
|---|---|---|---|
| 3,153,395 | 10/1964 | Karp | 102/387 X |
| 3,957,235 | 5/1976 | Centofanti | 244/152 |
| 4,697,765 | 10/1987 | Wimmer | 244/152 |
| 5,054,398 | 10/1991 | Dobler et al. | 102/387 |

*Primary Examiner*—Joseph F. Peters, Jr.
*Assistant Examiner*—Christopher P. Ellis
*Attorney, Agent, or Firm*—Spencer, Frank & Schneider

[57] ABSTRACT

A submunition unit provided with a rotary parachute (3) as the sole parachute. The parachute, after release, initially is unable to be fully deployed due to reef loops (16) provided on the rigging lines (15) and held by a releasable holding device arrangement (4, 5, 6) and therefore acts as a deceleration and stabilization parachute at high flight velocities. The reef loops (16) are released after a predetermined period of time to permit the rigging lines (15) to fully extend and parachute (3) to become fully deployed or opened.

8 Claims, 5 Drawing Sheets

SUBMUNITION UNIT INCLUDING A ROTARY PARACHUTE

CROSS-REFERENCE TO RELATED APPLICATIONS

This application claims the priority of Federal Republic of Germany application Serial No. P 41 24 960.7 filed July 27th, 1991, which is incorporated herein by reference.

BACKGROUND OF THE INVENTION

The present invention relates to a submunition unit having a rotary parachute disposed at a tail of the unit beneath a releasable cover and provided with rigging lines attached to the unit.

Homing submunition units i.e. submunition units provided with a search head, are usually decelerated and stabilized by means of a rotary parachute. However, the rotary parachute which is intended to cause the submunition unit to rotate at low descending velocities while searching for a target cannot be activated at high subsonic speeds since it would then immediately become twisted. In order to decelerate the submunition unit to a sufficiently low speed which makes it possible for the rotary parachute to become effective, deceleration parachutes are employed so that the operational sequence is separated into a deceleration and stabilization phase with the aid of the deceleration parachute and a rotation of the system phase with the aid of the rotary parachute which is deployed only at low flow velocities. The use of two parachutes is expensive with respect to design as well as assembly.

SUMMARY OF THE INVENTION

It is an object of the present invention to provide a submunition unit of the above discussed type in which a deceleration parachute is not required.

The above object is generally achieved according to the present invention by a submunition unit having a rotary parachute disposed at a tail of the unit underneath a releasable cover and provided with rigging lines, and means for connecting the free ends of the rigging lines to the unit, and wherein: a reef loop is provided for each of the rigging lines between the parachute and the associated free end; and a releasable holding means, which is mounted on said unit, is provided for normally engaging the reef loops, so that the rotary parachute, after being deployed, is initially in a reefed state and acts as a deceleration parachute, and for releasing the reef loops after a predetermined period of time, for example by a timer, so that the parachute becomes fully opened.

According to the preferred embodiment of the invention, the holding means includes a plurality of projections that are oriented rearwardly toward the rotary parachute, with the reef loops being placed around respective free ends of the projections, a plate which covers the free ends of the projections, means for normally maintaining the plate in engagement with the free ends of the projections, and a means for permitting movement of the plate by a predetermined distance in the direction toward the rotary parachute sufficient to release the reef loops from the projections upon release of the means for maintaining.

Preferably the means for normally maintaining the plate in engagement with the free ends of the projections comprises an explosive screw includes a device provided with an explosive charge which upon detonation releases the maintaining means.

The invention will be described below in greater detail with reference to an embodiment thereof that is illustrated in the attached drawing figures.

DETAILED DESCRIPTION OF THE PREFERRED EMBODIMENTS

Figure 3:
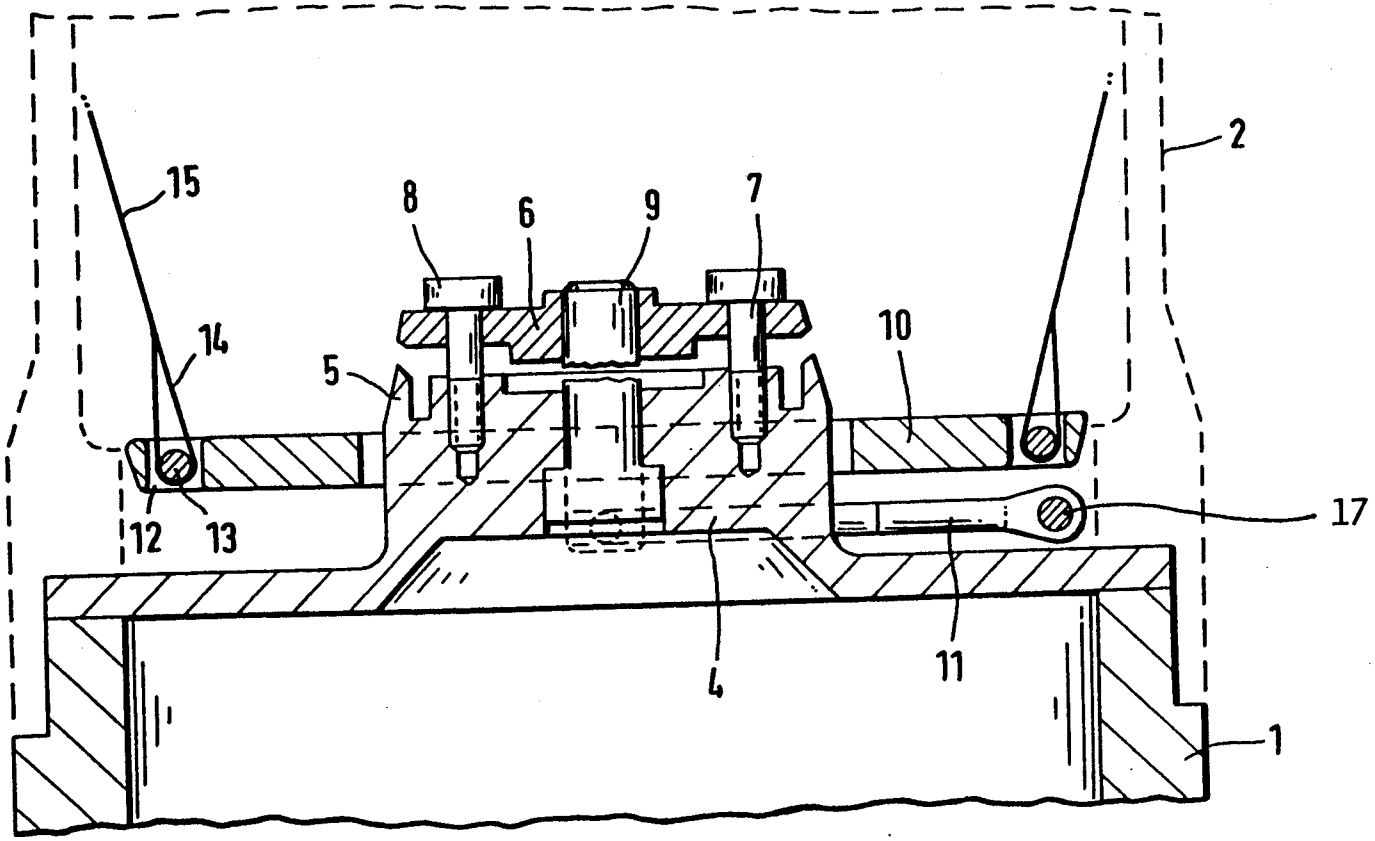

Referring to the Figures there is shown a submunition unit 1 including for example a search head, an explosive and a fuze in a known manner, and provided with a releasably arranged cover 2 at its tail in which a rotary parachute 3 is accommodated at least in part. Rotary parachute 3 is articulated to the tail end of submunition unit 1. For this purpose the tail of submunition unit 1 is provided with a crown 4 having tooth-like projections 5 which are oriented in a direction toward the rotary parachute 3. Projections 5 are covered at the tail side by a crown plate 6 through which extend several threaded bolts 7 which are screwed into crown 4 and whose heads 8 are arranged at a predetermined distance from the adjacent end surface of crown plate 6 so that the latter is able to perform a lifting movement of predetermined length in the direction toward rotary parachute 3. In the non-activated state shown in FIG. 3, crown plate 6 is screwed to crown 4 by an explosive screw 9 in a manner such that crown plate 6 rests on or engages the tail-side free ends of the projections 5.

Explosive screw 9 includes, in a known manner, a small explosive charge whose activation leads to explosive screw 9 bursting into two pieces approximately in the region between crown 4 and crown plate 6, thus enabling crown plate 6 to move by the length defined by threaded bolts 7. The explosive charge in explosive screw 9 can be activated by a timer 22 which is initiated by the trigger pin 20 when the submunition leaves the launch device.

The rigging lines 15 for the rotary parachute 3 are attached to an articulating ring 10 which initially surrounds crown 4 (FIG. 2) and is fastened by way of a rotary pivot joint 11 to submunition unit 1 at an eccentric location 17. Articulating ring 10 is provided with holes 12 which are arranged at regular intervals along its circumferential region and accommodates a ring of steel wire 13 around which are placed the end loops 14 of the rigging lines 15 for rotary parachute 3.

Figure 2:
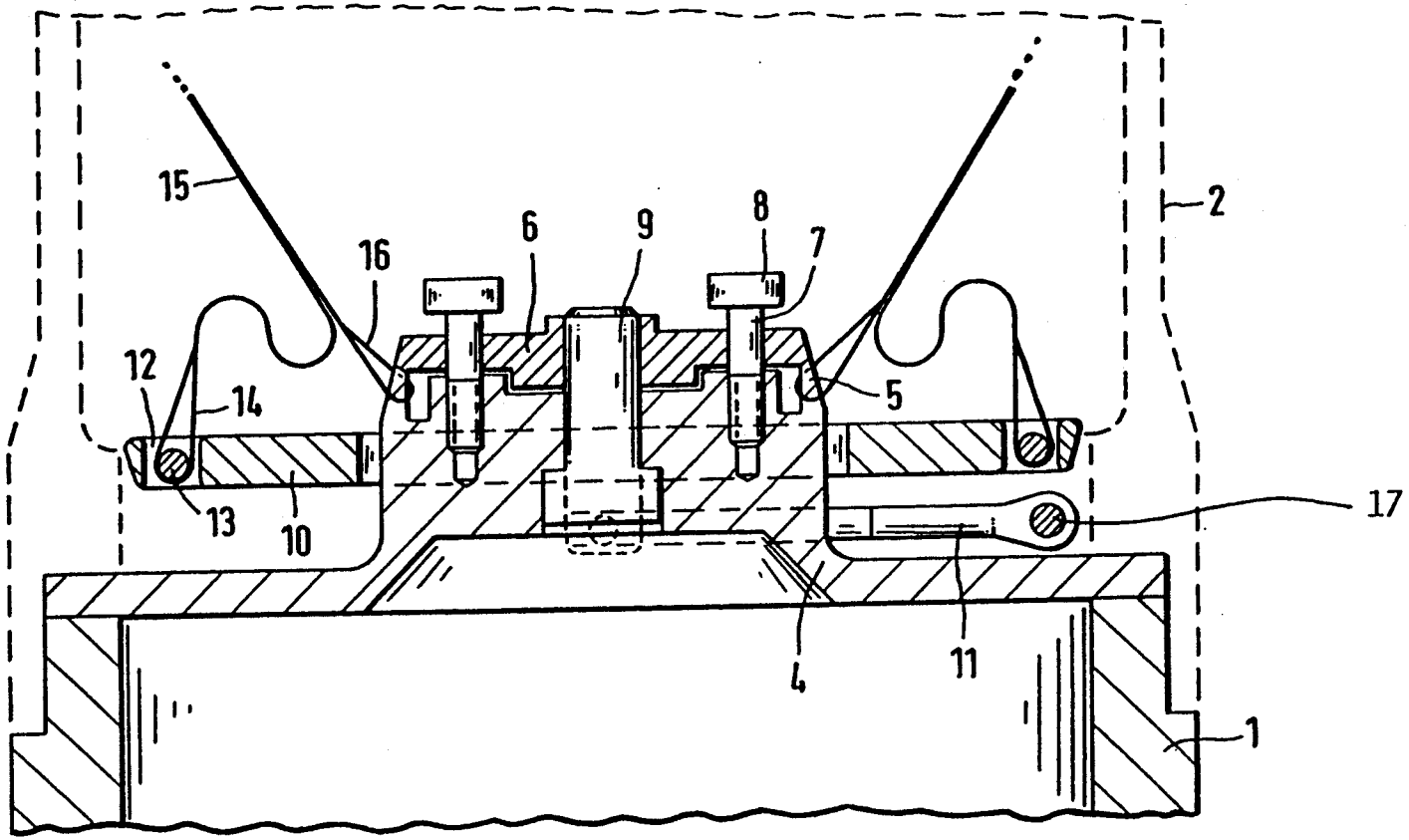
FIGS. 2 and 3 are sectional views of the releasable holding arrangement according to the preferred embodiment of the invention for attaching the parachute to the submunition unit in the non-activated and activated states, respectively.

Rigging lines 15 are additionally provided with respective reef loops 16 which are preferably disposed approximately at a distance of one-third of the length of rigging lines 15 from articulating ring 10. During assembly, reef loops 16 are placed around projections 5 and are secured against release by fastening of the crown plate 6 to the crown 4 via the bolt 9 as shown in FIG. 2.

Figure 1A:
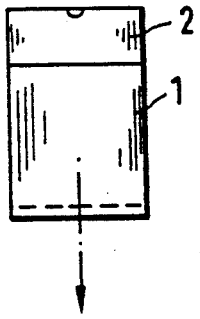
FIGS. 1*a*–1*d* are schematic illustrations showing a submunition unit according to the invention in various stages of activation or deployment of its parachute.
Figure 1B:
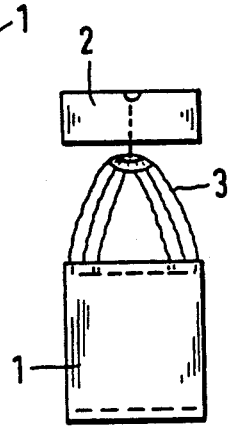
Figure 1C:
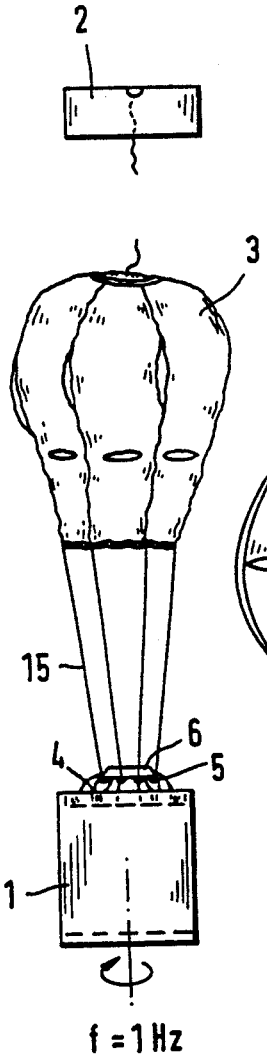

Removal or release of cover 2 from the submunition unit of FIG. 1*a* releases rotary parachute 3 at an initial high flight velocity as shown in FIG 1*b*. However due to the reef loops 16 being secured by the projection 5 and cover plate 6, the rigging lines 15 are correspondingly shortened so that rotary parachute 3 is deployed only partially and thus takes on a pear shape as shown in FIG. 1*c*. In this reefed state, rotary parachute 3 acts as a deceleration and stabilization parachute. It thus generates a slight rolling moment so that it will not become twisted.

Figure 1D:
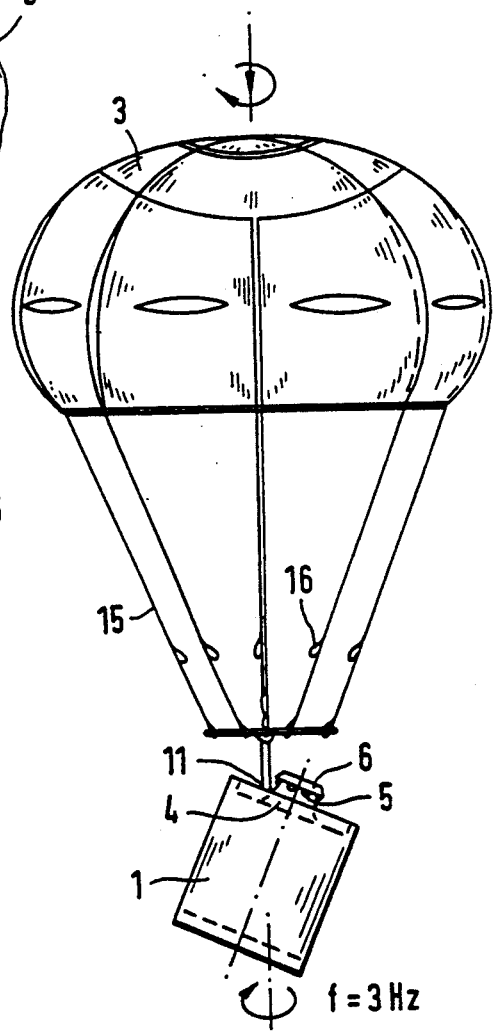

After initiation of full deployment of the parachute after a given period of time, e.g., by the timer, in that the explosive screw 9 is severed so that crown plate 6 is able to move axially relative to crown 4 and thus reef loops 16 come out of engagement with projections 5 due to the tension exerted on rigging lines 15, the rigging lines 15 extend to their full length and rotary parachute 3 fills completely (see FIG. 1*d*), thereby developing the aerodynamic forces and moments (resistance, roll and stabilizing resetting moments) required for a rotary descent. Release of reef loops 16 causes rigging lines 15 to exert tension on the articulating ring 10 which thus moves relative to the submunition unit 1 in the direction toward rotary parachute 3 by pivoting of rotary pivot joint 11, causing submunition unit 1 to hang from rotary parachute 3 with its axis at an angle to the vertical as further shown in FIG. 1*d*. A rotation of, for example, 1 Hz is generated during the deceleration phase and of 3 Hz during the descending phase after full deployment.

Figure 4:
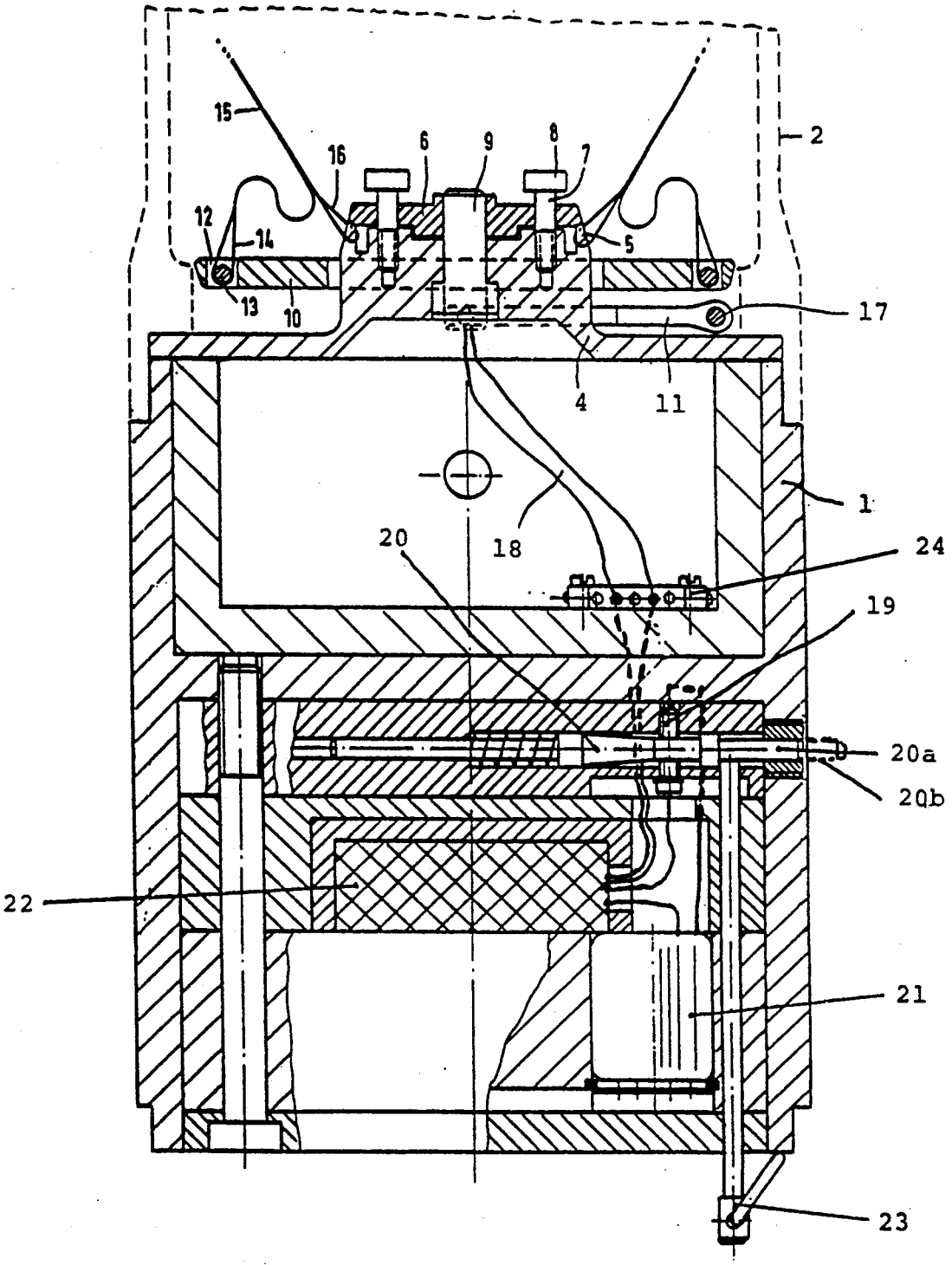
FIG. 4 is a schematic illustration of a test submunition including the trigger pin 20, timer 22, explosive screw 9 and the wiring 18.
Figure 5:
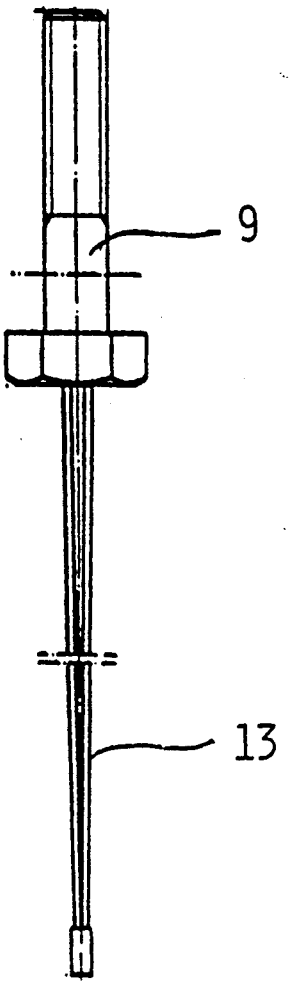
FIG. 5 provides reference of an explosive screw.

Instead of the holding device for reef loops 16 formed by the co-action of crown 4 and crown plate 6, hooks or eyes, for example, may also be employed, which may be opened by a release mechanism that is controlled by a timer. The elements causing the opening or release of the holding device for the reefing loops 16 may also be spring tensioned in the open position and may be held in the closed position by means of an explosive screw 9 or another suitable unlocking device. During the assembly of the subminition the safety pin 23 holds the trigger pin 20 in position 20*a*, preventing the start of the timer 22. When the submunition leaves the launch device, trigger pin 20 (shown in FIG. 4), moves into position "b". In position "b" the conical part of the trigger pin 20 has moved into contact with screw 19, making connection between the battery 21 and the timer 22, and starts the timer. The timer is a simple electronic device and is state of the art. After a preset delay time the timer switches power to the explosive screw 9 via wires 18 and clamp 24.

Since only a single parachute is employed, the arrangement saves space and assembly is easy. Submunition unit 1 can be decelerated and stabilized in a very short time since only one parachute is activated, with the aerodynamic forces being distributed better during the flight stabilization phase. Twisting of the rigging lines 15 at high flight velocities is prevented.

The invention now being fully described, it will be apparent to one of ordinary skill in the art that any changes and modifications can be made thereto without departing from the spirit or scope of the invention as set forth herein.

What is claimed is:

1. In a submunition unit including a rotary parachute disposed at a tail of said unit underneath a releasable cover and provided with rigging lines, and means for connecting the free ends of said rigging lines to said unit; the improvement comprising: a respective reef loop provided for each of said rigging lines between said parachute and an associated said free end; and a releasable holding means, mounted on said unit, for normally engaging said reef loops, so that said rotary parachute, after being deployed, is initially in a reefed state and acts as a deceleration parachute, and for releasing said reef loops after a predetermined period of time to permit the parachute to fully open.

2. A submunition unit as defined in claim 1, wherein said holding means includes: a plurality of projections that are oriented rearwardly toward said rotary parachute, with said reef loops being placed around respective free ends of said projections; a plate which covers said free ends of said projections; means for normally maintaining said plate in engagement with said free ends of said projections; and means for permitting movement of said plate by a predetermined distance in a direction toward said rotary parachute sufficient to release said reef loops from said projections upon release of said means for maintaining.

3. A submunition unit as defined in claim 2, wherein said means for normally maintaining said plate in engagement with said free ends of said projections includes a device provided with an explosive charge for releasing said means for normally maintaining upon detonation.

4. A submunition unit as defined in claim 2, wherein said means for maintaining said plate in engagement with said projections is an explosive screw connecting said plate to said unit.

5. A submunition unit as defined in claim 1 wherein said holding means includes a device provided with an explosive charge for causing said holding means to release said reef loops.

6. A submunition unit as defined in claim 5, wherein said device is an explosive screw.

7. A submunition unit as defined in claim 1 wherein said means for connecting said free ends of said rigging lines to said submunition unit includes a rotary pivot joint.

8. A submunition unit as defined in claim 1 wherein said reef loops are disposed at approximately one third of the length of said rigging lines from said free ends of said rigging lines.

* * * * *